US010054009B2

(12) United States Patent
Scott

(10) Patent No.: US 10,054,009 B2
(45) Date of Patent: Aug. 21, 2018

(54) TURBINE EXHAUST CASE MULTI-PIECE FRAME

(71) Applicant: United Technologies Corporation, Hartford, CT (US)

(72) Inventor: Jonathan Ariel Scott, Southington, CT (US)

(73) Assignee: United Technologies Corporation, Farmington, CT (US)

( * ) Notice: Subject to any disclaimer, the term of this patent is extended or adjusted under 35 U.S.C. 154(b) by 372 days.

(21) Appl. No.: 14/758,273

(22) PCT Filed: Dec. 20, 2013

(86) PCT No.: PCT/US2013/077003
§ 371 (c)(1),
(2) Date: Jun. 29, 2015

(87) PCT Pub. No.: WO2014/105716
PCT Pub. Date: Jul. 3, 2014

(65) Prior Publication Data

US 2015/0354411 A1 Dec. 10, 2015

Related U.S. Application Data

(60) Provisional application No. 61/747,819, filed on Dec. 31, 2012.

(51) Int. Cl.
*F01D 25/28* (2006.01)
*F01D 25/24* (2006.01)
*F01D 25/30* (2006.01)

(52) U.S. Cl.
CPC ..... *F01D 25/28* (2013.01); *F01D 25/24* (2013.01); *F01D 25/30* (2013.01); *Y10T 29/49323* (2015.01)

(58) Field of Classification Search
CPC ..... F01D 25/28; F01D 25/24; F01D 25/30; F01D 1/18; F01D 25/126; F01D 25/243
(Continued)

(56) References Cited

U.S. PATENT DOCUMENTS 2,214,108 A 7/1938 Grece
3,576,328 A 4/1971 Vose
(Continued)

FOREIGN PATENT DOCUMENTS

JP H06235331 A 8/1994
JP H0135969 A 5/1996
(Continued)

OTHER PUBLICATIONS

International Search Report and Written Opinion from PCT Application Serial No. PCT/US2013/077003, dated Apr. 14, 2014, 11 pages.
(Continued)

*Primary Examiner* — Eldon Brockman
(74) *Attorney, Agent, or Firm* — Kinney & Lange, P.A.

(57) ABSTRACT

A turbine exhaust case (28) comprises a one-piece fairing (120) defining an air-flow path through the turbine exhaust case, and a multi-piece frame (100). The multi-piece frame is disposed through and around the one-piece vane fairing to support a bearing load, and comprises an inner ring (104), an outer ring (102), a plurality of covers (110), and a plurality of radial struts (106). The outer ring is disposed concentrically outward of the inner ring, and has hollow bosses (114) with strut apertures (SA) at vane locations. The covers are secured to the hollow bosses. The radial struts pass through the one-piece vane fairing and through apertures in the outer angled ring, and are radially fastened to the inner ring and the flat caps.

19 Claims, 3 Drawing Sheets

(58) Field of Classification Search
USPC ..... 415/200, 213
See application file for complete search history.

(56) References Cited

U.S. PATENT DOCUMENTS

| | | | |
|---|---|---|---|
| 3,802,046 | A | 4/1974 | Wachtell et al. |
| 3,970,319 | A | 7/1976 | Carroll et al. |
| 4,009,569 | A | 3/1977 | Kozlin |
| 4,044,555 | A | 4/1977 | McLoughlin et al. |
| 4,088,422 | A | 5/1978 | Martin |
| 4,114,248 | A | 9/1978 | Smith et al. |
| 4,305,697 | A | 12/1981 | Cohen et al. |
| 4,321,007 | A | 3/1982 | Dennison et al. |
| 4,369,016 | A | 1/1983 | Dennison |
| 4,478,551 | A | 10/1984 | Honeycutt, Jr. et al. |
| 4,645,217 | A | 2/1987 | Honeycutt, Jr. et al. |
| 4,678,113 | A | 7/1987 | Bridges et al. |
| 4,738,453 | A | 4/1988 | Ide |
| 4,756,536 | A | 7/1988 | Belcher |
| 4,793,770 | A | 12/1988 | Schonewald et al. |
| 4,920,742 | A | 5/1990 | Nash et al. |
| 4,987,736 | A | 1/1991 | Ciokajlo et al. |
| 4,989,406 | A | 2/1991 | Vdoviak et al. |
| 4,993,918 | A | 2/1991 | Myers et al. |
| 5,031,922 | A | 7/1991 | Heydrich |
| 5,042,823 | A | 8/1991 | Mackay et al. |
| 5,071,138 | A | 12/1991 | Mackay et al. |
| 5,076,049 | A | 12/1991 | VonBenken et al. |
| 5,100,158 | A | 3/1992 | Gardner |
| 5,108,116 | A | 4/1992 | Johnson et al. |
| 5,169,159 | A | 12/1992 | Pope et al. |
| 5,174,584 | A | 12/1992 | Lahrman |
| 5,188,507 | A | 2/1993 | Sweeney |
| 5,211,541 | A | 5/1993 | Fledderjohn et al. |
| 5,236,302 | A | 8/1993 | Weisgerber et al. |
| 5,246,295 | A | 9/1993 | Ide |
| 5,265,807 | A | 11/1993 | Steckbeck et al. |
| 5,269,057 | A | 12/1993 | Mendham |
| 5,272,869 | A | 12/1993 | Dawson et al. |
| 5,273,397 | A | 12/1993 | Czachor et al. |
| 5,292,227 | A | 3/1994 | Czachor et al. |
| 5,312,227 | A | 5/1994 | Grateau et al. |
| 5,338,154 | A | 8/1994 | Meade et al. |
| 5,357,744 | A | 10/1994 | Czachor et al. |
| 5,370,402 | A | 12/1994 | Gardner et al. |
| 5,385,409 | A | 1/1995 | Ide |
| 5,401,036 | A | 3/1995 | Basu |
| 5,438,756 | A | 8/1995 | Halchak et al. |
| 5,474,305 | A | 12/1995 | Flower |
| 5,482,431 | A | 1/1996 | Taylor |
| 5,483,792 | A | 1/1996 | Czachor et al. |
| 5,558,341 | A | 9/1996 | McNickle et al. |
| 5,597,286 | A | 1/1997 | Dawson et al. |
| 5,605,438 | A | 2/1997 | Burdgick et al. |
| 5,609,467 | A | 3/1997 | Lenhart et al. |
| 5,632,493 | A | 5/1997 | Gardner |
| 5,634,767 | A | 6/1997 | Dawson |
| 5,645,397 | A | 7/1997 | Soecuting et al. |
| 5,691,279 | A | 11/1997 | Tauber et al. |
| 5,755,445 | A | 5/1998 | Arora |
| 5,851,105 | A | 12/1998 | Fric et al. |
| 5,911,400 | A | 6/1999 | Niethammer et al. |
| 6,163,959 | A | 12/2000 | Arraitz et al. |
| 6,196,550 | B1 | 3/2001 | Arora et al. |
| 6,227,800 | B1 | 5/2001 | Spring et al. |
| 6,337,751 | B1 | 1/2002 | Kimizuka |
| 6,343,912 | B1 | 2/2002 | Mangeiga et al. |
| 6,358,001 | B1 | 3/2002 | Bosel et al. |
| 6,364,316 | B1 | 4/2002 | Arora |
| 6,439,841 | B1 | 8/2002 | Bosel |
| 6,511,284 | B2 | 1/2003 | Darnell et al. |
| 6,578,363 | B2 | 6/2003 | Hashimoto et al. |
| 6,601,853 | B2 | 8/2003 | Inoue |
| 6,612,807 | B2 | 9/2003 | Czachor |
| 6,619,030 | B1 | 9/2003 | Seda et al. |
| 6,638,013 | B2 | 10/2003 | Nguyen et al. |
| 6,652,229 | B2 | 11/2003 | Lu |
| 6,672,833 | B2 | 1/2004 | MacLean et al. |
| 6,719,524 | B2 | 4/2004 | Nguyen et al. |
| 6,736,401 | B2 | 5/2004 | Chung et al. |
| 6,792,758 | B2 | 9/2004 | Dowman |
| 6,796,765 | B2 | 9/2004 | Kosel et al. |
| 6,805,356 | B2 | 10/2004 | Inoue |
| 6,811,154 | B2 | 11/2004 | Proctor et al. |
| 6,935,631 | B2 | 8/2005 | Inoue |
| 6,969,826 | B2 | 11/2005 | Trewiler et al. |
| 6,983,608 | B2 | 1/2006 | Allen, Jr. et al. |
| 7,055,305 | B2 | 6/2006 | Baxter et al. |
| 7,094,026 | B2 | 8/2006 | Coign et al. |
| 7,100,358 | B2 | 9/2006 | Gekht et al. |
| 7,200,933 | B2 | 4/2007 | Lundgren et al. |
| 7,229,249 | B2 | 6/2007 | Durocher et al. |
| 7,238,008 | B2 | 7/2007 | Bobo et al. |
| 7,367,567 | B2 | 5/2008 | Farah et al. |
| 7,371,044 | B2 | 5/2008 | Nereim |
| 7,389,583 | B2 | 6/2008 | Lundgren |
| 7,614,150 | B2 | 11/2009 | Lundgren |
| 7,631,879 | B2 | 12/2009 | Diantonio |
| 7,673,461 | B2 | 3/2010 | Cameriano et al. |
| 7,677,047 | B2 | 3/2010 | Somanath et al. |
| 7,735,833 | B2 | 6/2010 | Braun et al. |
| 7,798,768 | B2 | 9/2010 | Strain et al. |
| 7,815,417 | B2 | 10/2010 | Somanath et al. |
| 7,824,152 | B2 | 11/2010 | Morrison |
| 7,891,165 | B2 | 2/2011 | Bader et al. |
| 7,909,573 | B2 | 3/2011 | Cameriano et al. |
| 7,955,446 | B2 | 6/2011 | Dierberger |
| 7,959,409 | B2 | 6/2011 | Guo et al. |
| 7,988,799 | B2 | 8/2011 | Dierberger |
| 8,069,648 | B2 | 12/2011 | Snyder et al. |
| 8,083,465 | B2 | 12/2011 | Herbst et al. |
| 8,091,371 | B2 | 1/2012 | Durocher et al. |
| 8,092,161 | B2 | 1/2012 | Cai et al. |
| 8,152,451 | B2 | 4/2012 | Manteiga et al. |
| 8,162,593 | B2 | 4/2012 | Guimbard et al. |
| 8,172,526 | B2 | 5/2012 | Lescure et al. |
| 8,177,488 | B2 | 5/2012 | Manteiga et al. |
| 8,221,071 | B2 | 7/2012 | Wojno et al. |
| 8,245,399 | B2 | 8/2012 | Anantharaman et al. |
| 8,245,518 | B2 | 8/2012 | Durocher et al. |
| 8,282,342 | B2 | 10/2012 | Tonks et al. |
| 8,371,127 | B2 | 2/2013 | Durocher et al. |
| 8,371,812 | B2 | 2/2013 | Manteiga et al. |
| 2003/0025274 | A1 | 2/2003 | Allan et al. |
| 2003/0042682 | A1 | 3/2003 | Inoue |
| 2003/0062684 | A1 | 4/2003 | Inoue |
| 2003/0062685 | A1 | 4/2003 | Inoue |
| 2005/0046113 | A1 | 3/2005 | Inoue |
| 2006/0010852 | A1 | 1/2006 | Gekht et al. |
| 2008/0216300 | A1 | 9/2008 | Anderson et al. |
| 2010/0132370 | A1 | 6/2010 | Durocher et al. |
| 2010/0132371 | A1 | 6/2010 | Durocher et al. |
| 2010/0132374 | A1 | 6/2010 | Manteiga et al. |
| 2010/0132377 | A1 | 6/2010 | Durocher et al. |
| 2010/0202872 | A1 | 8/2010 | Weidmann |
| 2010/0236244 | A1 | 9/2010 | Longardner |
| 2010/0275572 | A1 | 11/2010 | Durocher et al. |
| 2010/0275614 | A1 | 11/2010 | Fontaine et al. |
| 2010/0307165 | A1 | 12/2010 | Wong et al. |
| 2011/0000223 | A1 | 1/2011 | Russberg |
| 2011/0005234 | A1 | 1/2011 | Hashimoto et al. |
| 2011/0061767 | A1 | 3/2011 | Vontell et al. |
| 2011/0078902 | A1 | 4/2011 | Durocher et al. |
| 2011/0081239 | A1 | 4/2011 | Durocher |
| 2011/0081240 | A1 | 4/2011 | Durocher et al. |
| 2011/0085895 | A1 | 4/2011 | Durocher et al. |
| 2011/0214433 | A1 | 9/2011 | Feindel et al. |
| 2011/0262277 | A1 | 10/2011 | Sjoqvist et al. |
| 2011/0302929 | A1 | 12/2011 | Bruhwiler |
| 2012/0111023 | A1 | 5/2012 | Sjoqvist et al. |
| 2012/0156020 | A1 | 6/2012 | Kottilingam et al. |
| 2012/0171019 | A1 | 7/2012 | Moon |

(56) References Cited

U.S. PATENT DOCUMENTS

| | | | |
|---|---|---|---|
| 2012/0186254 | A1 | 7/2012 | Ito et al. |
| 2012/0204569 | A1 | 8/2012 | Schubert |
| 2013/0011242 | A1 | 1/2013 | Beeck et al. |

FOREIGN PATENT DOCUMENTS

| | | | |
|---|---|---|---|
| JP | 2008082323 | A | 4/2008 |
| JP | 2010127277 | A | 6/2010 |
| WO | WO 03/020469 | A1 | 3/2003 |
| WO | WO 2006/007686 | A1 | 1/2006 |
| WO | WO 2009/157817 | A1 | 12/2009 |
| WO | WO 2010/002295 | A1 | 1/2010 |
| WO | WO 2012/158070 | A1 | 11/2012 |

OTHER PUBLICATIONS

Notice of Reasons for Rejection from Japanese Patent Application No. JPA2015-550699, dated Jun. 13, 2017, 5 pages.

TURBINE EXHAUST CASE MULTI-PIECE FRAME

BACKGROUND

The present disclosure relates generally to gas turbine engines, and more particularly to heat management in a turbine exhaust case of a gas turbine engine.

A turbine exhaust case is a structural frame that supports engine bearing loads while providing a gas path at or near the aft end of a gas turbine engine. Some aeroengines utilize a turbine exhaust case to help mount the gas turbine engine to an aircraft airframe. In industrial applications, a turbine exhaust case is more commonly used to couple gas turbine engines to a power turbine that powers an electrical generator. Industrial turbine exhaust cases may, for instance, be situated between a low pressure engine turbine and a generator power turbine. A turbine exhaust case must bear shaft loads from interior bearings, and must be capable of sustained operation at high temperatures.

Turbine exhaust cases serve two primary purposes: airflow channeling and structural support. Turbine exhaust cases typically comprise structures with inner and outer rings connected by radial struts. The struts and rings often define a core flow path from fore to aft, while simultaneously mechanically supporting shaft bearings situated axially inward of the inner ring. The components of a turbine exhaust case are exposed to very high temperatures along the core flow path. Various approaches and architectures have been employed to handle these high temperatures. Some turbine exhaust case frames utilize high-temperature, high-stress capable materials to both define the core flow path and bear mechanical loads. Other turbine exhaust case architectures separate these two functions, pairing a structural frame for mechanical loads with a high-temperature capable fairing to define the core flow path. Turbine exhaust cases with separate structural frames and flow path fairings pose the technical challenge of installing vane fairings within the structural frame. Fairings are typically constructed as a "ship in a bottle," built piece-by-piece within a unitary frame. Some fairing embodiments, for instance, comprise suction and pressure side pieces of fairing vanes for each frame strut. These pieces are inserted individually inside the structural frame, and joined together (e.g. by welding) to surround frame struts.

SUMMARY

The present disclosure is directed toward a turbine exhaust case comprising a one-piece vane fairing defining an airflow path through the turbine exhaust case, and a multi-piece frame. The multi-piece frame is disposed through and around the one-piece vane fairing to support a bearing load, and comprises an inner ring, an outer ring, a plurality of covers, and a plurality of radial struts. The outer ring is disposed concentrically outward of the inner ring, and has hollow bosses with strut apertures at vane locations. The covers are secured to the hollow bosses. The radial struts pass through the one-piece vane fairing and through apertures in the outer angled ring, and are radially fastened to the inner ring and the flat caps.

DETAILED DESCRIPTION

Figure 1:
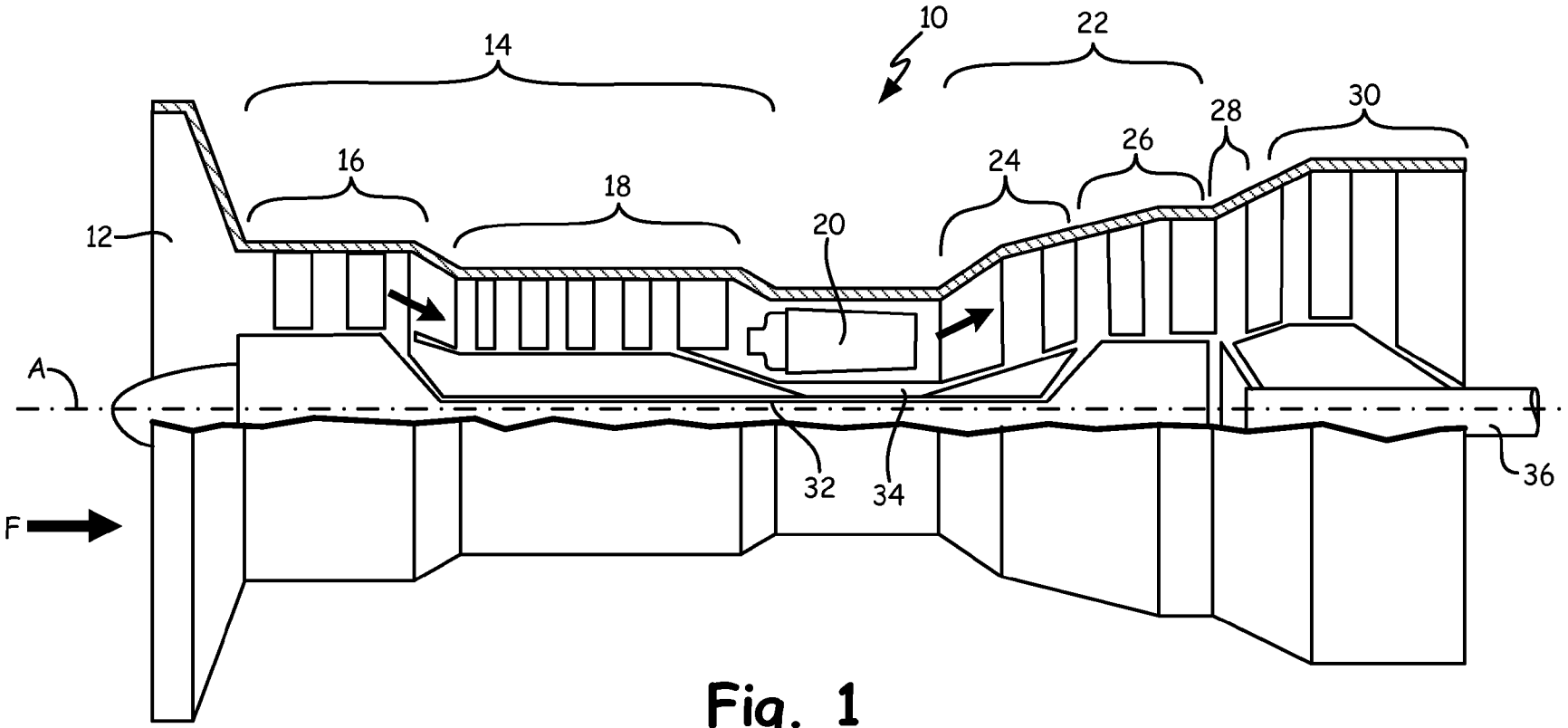
FIG. 1 is a schematic view of a gas turbine generator.

FIG. 1 is a simplified partial cross-sectional view of gas turbine engine 10, comprising inlet 12, compressor 14 (with low pressure compressor 16 and high pressure compressor 18), combustor 20, engine turbine 22 (with high pressure turbine 24 and low pressure turbine 26), turbine exhaust case 28, power turbine 30, low pressure shaft 32, high pressure shaft 34, and power shaft 36. Gas turbine engine 10 can, for instance, be an industrial power turbine.

Low pressure shaft 32, high pressure shaft 34, and power shaft 36 are situated along rotational axis A. In the depicted embodiment, low pressure shaft 32 and high pressure shaft 34 are arranged concentrically, while power shaft 36 is disposed axially aft of low pressure shaft 32 and high pressure shaft 34. Low pressure shaft 32 defines a low pressure spool including low pressure compressor 16 and low pressure turbine 26. High pressure shaft 34 analogously defines a high pressure spool including high pressure compressor 18 and high pressure turbine 24. As is well known in the art of gas turbines, airflow F is received at inlet 12, then pressurized by low pressure compressor 16 and high pressure compressor 18. Fuel is injected at combustor 20, where the resulting fuel-air mixture is ignited. Expanding combustion gasses rotate high pressure turbine 24 and low pressure turbine 26, thereby driving high and low pressure compressors 18 and 16 through high pressure shaft 34 and low pressure shaft 32, respectively. Although compressor 14 and engine turbine 22 are depicted as two-spool components with high and low sections on separate shafts, single spool or three or more spool embodiments of compressor 14 and engine turbine 22 are also possible. Turbine exhaust case 28 carries airflow from low pressure turbine 26 to power turbine 30, where this airflow drives power shaft 36. Power shaft 36 can, for instance, drive an electrical generator, pump, mechanical gearbox, or other accessory (not shown).

In addition to defining an airflow path from low pressure turbine 26 to power turbine 30, turbine exhaust case 28 can support one or more shaft loads. Turbine exhaust case 28 can, for instance, support low pressure shaft 32 via bearing compartments (not shown) disposed to communicate load from low pressure shaft 32 to a structural frame of turbine exhaust case 28.

Figure 2:
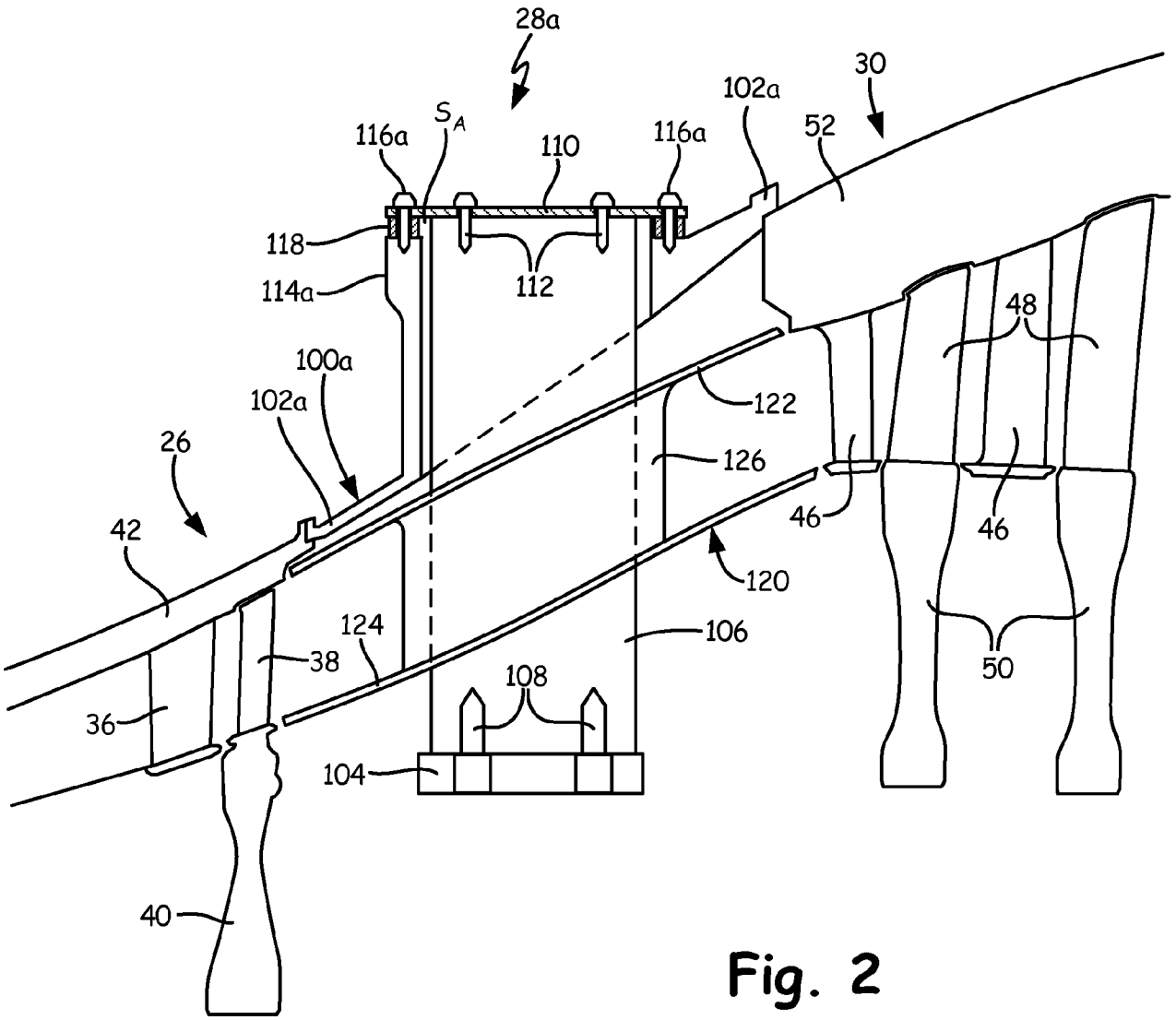
FIG. 2 is a simplified cross-sectional view of a first turbine exhaust case of the gas turbine generator of FIG. 1.

FIG. 2 is a simplified cross-sectional view of one embodiment of turbine exhaust case 28, labeled turbine exhaust case 28*a*. FIG. 2 illustrates low pressure turbine 26 (with low pressure turbine casing 42, low pressure vane 36, low pressure rotor blade 38, and low pressure rotor disk 40) and power turbine 30 (with power turbine case 52, power turbine vanes 46, power turbine rotor blades 48, and power turbine rotor disks 50), and turbine exhaust case 28*a* (with frame 100*a*, outer ring 102*a*, inner ring 104, strut 106, inner radial strut fasteners 108, cover 110, outer radial fasteners 112, strut boss 114*a*, cover fasteners 116*a*, seals 118, fairing 120, outer platform 122, inner platform 124, and fairing vane 126).

As noted above with respect to FIG. 1, low pressure turbine 26 is an engine turbine connected to low pressure compressor 16 via low pressure shaft 32. Low pressure turbine rotor blades 38 are axially stacked collections of circumferentially distributed airfoils anchored to low pressure turbine rotor disk 40. Although only one low pressure turbine rotor disk 40 and a single representative low pressure turbine rotor blade 38 are shown, low pressure turbine 26 may comprise any number of rotor stages interspersed with low pressure rotor vanes 36. Low pressure rotor vanes 36 are airfoil surfaces that channel flow F to impart aerodynamic loads on low pressure rotor blades 38, thereby driving low pressure shaft 32 (see FIG. 1). Low pressure turbine case 42 is a rigid outer surface of low pressure turbine 26 that carries radial and axial load from low pressure turbine components, e.g. to turbine exhaust case 28.

Power turbine 30 parallels low pressure turbine 26, but extracts energy from airflow F to drive a generator, pump, mechanical gearbox, or similar device, rather than to power compressor 14. Like low pressure turbine 26, power turbine 30 operates by channeling airflow through alternating stages of airfoil vanes and blades. Power turbine vanes 46 channel airflow F to rotate power turbine rotor blades 48 on power turbine rotor disks 50.

Turbine exhaust case 28 is an intermediate structure connecting low pressure turbine 26 to power turbine 30. Turbine exhaust case 28 may for instance be anchored to low pressure turbine 26 and power turbine 30 via bolts, pins, rivets, or screws. In some embodiments, turbine exhaust case 28 may serve as an attachment point for installation mounting hardware (e.g. trusses, posts) that supports not only turbine exhaust case 28, but also low pressure turbine 26, power turbine 30, and/or other components of gas turbine engine 10.

Turbine exhaust case 28 comprises two primary components: frame 100, which supports structural loads including shaft loads e.g. from low pressure shaft 32, and fairing 120, which defines an aerodynamic flow path from low pressure turbine 26 to power turbine 30. Fairing 120 can be formed in a unitary, monolithic piece, while frame 100 is assembled about fairing 120.

Outer platform 122 and inner platform 124 of fairing 120 define the inner and outer boundaries of an annular gas flow path from low pressure turbine 26 to power turbine 30. Fairing vane 126 is an aerodynamic vane surface surrounding strut 106. Fairing 120 can have any number of fairing vanes 126 at least equal to the number of struts 106. In one embodiment, fairing 120 has one vane fairing 126 for each strut 106 of frame 100. In other embodiments, fairing 120 may include additional vane fairings 126 through which no strut 106 passes. Fairing 120 can be formed of a high temperature capable material such as Inconel or another nickel-based superalloy.

Frame 100 is a multi-piece frame comprised of four distinct structural elements, plus connecting fasteners. The outer diameter of frame 100 is formed by the combination of outer ring 102 and a plurality of covers 110. Outer ring 102 is a rigid, substantially frustonical annulus with strut boss 114*a*. Strut boss 114*a* is a radially-extending hollow boss with substantially flat outer surfaces parallel to axis A. A plurality of strut bosses 114*a* can distributed about the circumference of outer ring 102*a* at angular locations corresponding to struts 106. Strut bosses 114*a* have strut apertures $S_A$ at their outer radial extents. Strut apertures $S_A$ are hollow passageways through strut boss 128 into which struts 106 can be inserted. Strut apertures $S_A$ are spanned by covers 110, which both provide an air seal to strut bosses 114*a*, and provide attachment points to struts 106. Covers 110 are secured to struts 106*a* by outer radial fasteners 112, and to strut bosses 114*a* of outer ring 102*a* by cover fasteners 116*a*. Cover fasteners 116*a* and outer radial fasteners 112 may, for instance, be pins, bolts, or screws extending through cover 110 and into strut boss 114*a* or strut 106, respectively. In some embodiments, seals 118 may be disposed between cover 110 and strut boss 114*a* to prevent fluid egress from within inner ring 102*a* via strut aperture $S_A$. Seals 118 may, for instance, be gaskets or other deformable seals. Cover fasteners 116*a* can be tightened or loosened to vary the radial distance of cover 110 from axis A, so as to control the radial position of strut 106.

The inner diameter of frame 100 is defined by inner ring 104, a substantially cylindrical structure with inner radial strut fasteners 108. Inner radial strut fasteners 108 may, for instance, be screws, pins, or bolts extending radially inward through inner ring 104 and into strut 106*a* to secure strut 106*a* at its radially inner extent to inner ring 104. In other embodiments, inner radial strut fasteners 108 may be radial posts extending radially inward from inner ring 106*a*, and mating with corresponding post holes at the inner diameter of strut 106*a*. Struts 106*a* are rigid posts extending substantially radially from inner ring 104, through fairing vanes 122, into strut bosses 126*a*. Struts 106*a* are anchored in all dimensions by the combination of inner radial fasteners 108 and outer radial fasteners 112. Frame 100 is not directly exposed to core flow F, and therefore can be formed of a material rated to significantly lower temperatures than fairing 120. In some embodiments, frame 100 may be formed of sand-cast steel.

Figure 3:
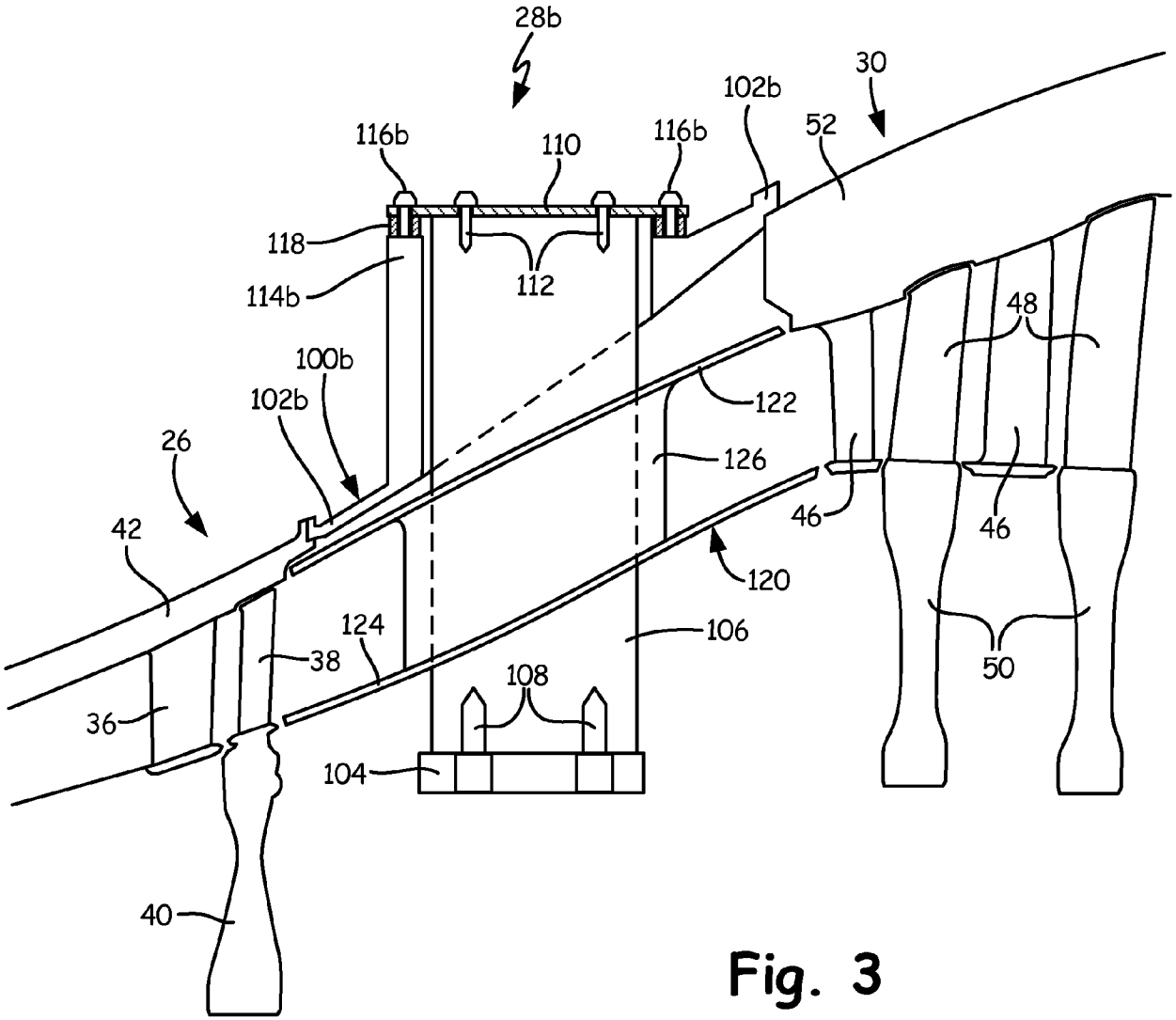
FIG. 3 is a simplified cross-sectional view of an alternative turbine exhaust case to the turbine exhaust case of FIG. 2.

FIG. 3 is a simplified cross-sectional view of an alternative embodiment of turbine exhaust case 28, labeled turbine exhaust case 28*b*. FIG. 3 illustrates low pressure turbine 26 (with low pressure turbine casing 42, low pressure vane 36, low pressure rotor blade 38, and low pressure rotor disk 40) and power turbine 30 (with power turbine case 52, power turbine vanes 46, power turbine rotor blades 48, and power turbine rotor disks 50), and turbine exhaust case 28*b* (with frame 100*b*, outer ring 102*b*, inner ring 204, strut 106, inner radial strut fasteners 108, cover 110, outer radial fasteners 112, strut boss 114*b*, cover spacers 116*b*, seals 118, fairing 120, outer platform 122, inner platform 124, and fairing vane 126). Turbine exhaust case 28*b* differs from turbine exhaust case 28*a* only in frame 100*b*, outer ring 102*b*, strut boss 114*a*, and cover spacers 116*b*; in every other way the embodiments depicted in FIGS. 2 and 3 are identical. Cover spacers 116*b* are adjustable spacers that abut, but do not thread into, strut boss 114*a*. Outer ring 102*b* of frame 102*b* features strut boss 114*b* without apertures, e.g. screw or bolts holes, for cover fasteners 116*a*. Rather than extending into strut boss 114*b*, cover spacers 116*b* contact strut boss 114*b* to determine the radial offset of cover 110 from strut boss 114*a*. In all other ways, turbine exhaust case 28*b* is substantially identical to turbine exhaust case 28*a*.

Turbine exhaust case 28 is assembled by axially and circumferentially aligning fairing 120 with inner ring 104 and outer ring 102, and slotting each strut 106 through strut aperture $S_A$ and fairing vane 126 from radially outside onto inner radial strut fasteners 108. In some embodiments (e.g. where inner radial strut fasteners are screws or bolts) inner radial strut fasteners 108 can then be secured to the inner diameter of strut 106. Cover 110 is then placed over strut aperture $S_A$ and secured to strut 106 via outer radial fasteners 112. Finally, cover fasteners 116*a* or cover spacers 116*b* are inserted through cover 110 to strut boss 114, and adjusted to define the radial position of strut 110. Although FIG. 2 depicts cover fasteners 116*a* and FIG. 3 depicts cover spacers 116*b*, some embodiments of turbine exhaust case 28 may include both fasteners that extend into strut boss 114 to secure cover 110 axially, and cover spacers that define the radial offset of cover 110 from strut boss 114. The multi-piece construction of frame 100 allows turbine exhaust case 28 to be assembled around fairing 120. Accordingly, fairing

120 can be a single, monolithically formed piece, e.g. a unitary die-cast body with no weak points corresponding to weld or other joint locations.

Discussion of Possible Embodiments

The following are non-exclusive descriptions of possible embodiments of the present invention.

A turbine exhaust case comprises a one-piece vane fairing defining an airflow path through the turbine exhaust case, and a multi-piece frame. The multi-piece frame is disposed through and around the one-piece vane fairing to support a bearing load, and comprises an inner ring, an outer ring, a plurality of covers, and a plurality of radial struts. The outer ring is disposed concentrically outward of the inner ring, and has hollow bosses with strut apertures at vane locations. The covers are secured to the hollow bosses. The radial struts pass through the one-piece vane fairing and through apertures in the outer angled ring, and are radially fastened to the inner ring and the flat caps.

The turbine exhaust case of the preceding paragraph can optionally include, additionally and/or alternatively, any one or more of the following features, configurations, and/or additional components:

wherein the multi-piece frame is formed of steel.

wherein the multi-piece frame is formed of sand-cast steel.

wherein the fairing is monolithically formed.

wherein the fairing is formed of a material rated for a higher temperature than the multi-piece frame.

wherein the fairing is formed of a nickel-based superalloy.

further comprising airtight seals disposed between the hollow bosses and the covers.

wherein the covers are secured to the hollow bosses via adjustable cover fasteners that extend through the covers into the hollow bosses, and that define a radial offset of the covers from the hollow bosses.

wherein the covers are spaced from the hollow bosses via adjustable cover spacers that abut the hollow bosses and define a radial offset of the covers from the hollow bosses.

wherein the radial struts are fastened to the outer covers and the inner ring via outer and inner radial bolts, respectively.

A turbine exhaust case frame comprises an inner cylindrical ring, an outer frustoconical ring with a plurality of angularly distributed hollow strut bosses, a plurality of radial struts secured to the inner cylindrical ring via radial fasteners, and a plurality of covers radially anchored to the radial struts, and spaced radially outward from the hollow strut bosses.

The turbine exhaust case frame of the preceding paragraph can optionally include, additionally and/or alternatively, any one or more of the following features, configurations, and/or additional components:

wherein the plurality of covers are anchored to and spaced radially outward from the hollow strut bosses by adjustable cover fasteners extending radially through the covers and into the hollow strut bosses.

wherein the plurality of covers are spaced radially outward from the hollow strut bosses by adjustable cover spacers extending radially through the covers and abutting the hollow strut bosses.

wherein the plurality of radial struts are anchored to the covers and the inner cylindrical ring via radial bolts.

further comprising airtight seals disposed between the hollow bosses and the covers.

A method of assembling a turbine exhaust case, the method comprising: aligning fairing vanes of a flow path defining fairing, radial fasteners on an inner frame ring, and strut apertures in a strut boss of an outer frustoconical ring; inserting a radial strut from radially outside the outer frustoconical ring, through the strut aperture and the fairing vane; securing the radial strut to the inner frame ring via the radial fasteners; securing the radial strut to a flat cover radially outside of the strut boss, and spanning the strut aperture; and adjusting the separation distance between the cover and the strut boss to adjust the radial position of the strut.

The method of the preceding paragraph can optionally include, additionally and/or alternatively, any one or more of the following features, configurations, and/or additional components:

wherein adjusting the separation distance between the cover and the strut comprises tightening or loosening a cover fastener extending through the cover into the strut boss.

wherein adjusting the separation distance between the cover and the strut comprises tightening or loosening a cover spacer extending through the cover and abutting the strut boss.

further comprising sealing the outer frustoconical ring with a seal situated between the flat cover and the strut boss.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A turbine exhaust case comprising:

a one-piece fairing defining an airflow path through the turbine exhaust case; and a multi-piece frame disposed through and around the one-piece fairing to support a bearing load, the multi-piece frame comprising:

an inner ring;

an outer ring disposed concentrically outward of the inner ring, and having hollow bosses with strut apertures at vane locations;

a plurality of covers secured to the hollow bosses;

a plurality of radial struts passing through the one-piece fairing and through the strut apertures in the outer ring, and radially fastened to the inner ring and the covers; and adjustment means extending radially through the covers to the hollow bosses to adjust the separation distance between the covers and the hollow bosses, and thereby adjust the radial position of each of the plurality of radial struts.

2. The gas turbine exhaust case of claim 1, wherein the multi-piece frame is formed of steel.

3. The gas turbine exhaust case of claim 2, wherein the multi-piece frame is formed of sand-cast steel.

4. The gas turbine exhaust case of claim 1, wherein the fairing is monolithically formed.

5. The gas turbine exhaust case of claim 1, wherein the fairing is formed of a material rated for a higher temperature than the multi-piece frame.

6. The gas turbine exhaust case of claim 1, wherein the fairing is formed of a nickel-based superalloy.

7. The gas turbine exhaust case of claim 1, further comprising airtight seals disposed between the hollow bosses and the covers.

8. The gas turbine exhaust case of claim 1, wherein the adjustment means are adjustable cover fasteners that secure the covers to the hollow bosses, and that extend into the hollow bosses.

9. The gas turbine exhaust case of claim 1, wherein the adjustment means are adjustable cover spacers that abut the hollow bosses.

10. The gas turbine exhaust case of claim 1, wherein each of the plurality of radial struts are fastened to the outer covers and the inner ring via outer and inner radial bolts, respectively.

11. A turbine exhaust case frame comprising:

an inner cylindrical ring;

an outer frustoconical ring with a plurality of angularly distributed hollow strut bosses;

a plurality of radial struts secured to the inner cylindrical ring via radial fasteners;

a plurality of covers radially anchored to each of the plurality of radial struts, and spaced radially outward from the hollow strut bosses; and adjustment means extending radially through the covers to the hollow strut bosses to adjust the separation distance between the covers and the hollow strut bosses, and thereby adjust the radial position of each of the plurality of radial struts.

12. The turbine exhaust case of claim 11, wherein the adjustment means comprise adjustable cover fasteners extending into the hollow strut bosses, and wherein the plurality of covers are anchored to and spaced radially outward from the hollow strut bosses by the adjustable cover fasteners.

13. The turbine exhaust case of claim 11, wherein the adjustment means comprise adjustable cover spacers abutting the hollow strut bosses, and wherein the plurality of covers are spaced radially outward from the hollow strut bosses by the adjustable cover spacers.

14. The turbine exhaust case of claim 11, wherein the plurality of radial struts are anchored to the covers and the inner cylindrical ring via radial bolts.

15. The turbine exhaust case of claim 11, further comprising airtight seals disposed between the hollow bosses and the covers.

16. A method of assembling a turbine exhaust case, the method comprising:

Aligning fairing vanes of a flow path defining fairing, radial fasteners on an inner frame ring, and strut apertures in a strut boss of an outer frustoconical ring;

inserting a radial strut from radially outside the outer frustoconical ring, through one of the strut aperture and the fairing vane;

securing the radial strut to the inner frame ring via the radial fasteners;

securing the radial strut to a flat cover radially outside of the strut boss, and spanning the one of the strut apertures; and adjusting the separation distance between the cover and the radial strut boss to adjust the radial position of the radial strut.

17. The method of claim 16, wherein adjusting the separation distance between the cover and the radial strut comprises tightening or loosening a cover fastener extending through the cover into the strut boss.

18. The method of claim 16, wherein adjusting the separation distance between the cover and the radial strut comprises tightening or loosening a cover spacer extending through the cover and abutting the strut boss.

19. The method of claim 16, further comprising sealing the outer frustoconical ring with a seal situated between the flat cover and the strut boss.

* * * * *